United States Patent [19]

Morita et al.

[11] Patent Number: 4,657,837

[45] Date of Patent: Apr. 14, 1987

[54] TONER FOR DEVELOPING AN ELECTROSTATICALLY CHARGED IMAGE

[75] Inventors: Hideaki Morita; Takahira Kasuya; Goichi Yamakawa; Makoto Tomono, all of Hachioji; Shinichiro Yasuda, Wakayama, all of Japan

[73] Assignee: Konishiroku Photo Industry Co., Ltd., Tokyo, Japan

[21] Appl. No.: 800,081

[22] Filed: Nov. 6, 1985

Related U.S. Application Data

[63] Continuation of Ser. No. 576,217, Feb. 2, 1984, abandoned, which is a continuation of Ser. No. 309,840, Aug. 11, 1980, abandoned.

[30] Foreign Application Priority Data

Aug. 15, 1980 [JP] Japan ..... 55-112836

[51] Int. Cl.[4] ..... G03G 9/08

[52] U.S. Cl. ..... 430/109; 430/904

[58] Field of Search ..... 430/109, 114, 904

[56] References Cited

U.S. PATENT DOCUMENTS 3,681,106 8/1972 Burns et al. ..... 430/120
3,985,664 10/1976 Sakaguchi ..... 430/109
4,176,078 11/1979 Lu ..... 430/109
4,202,785 5/1980 Merrill et al. ..... 430/115
4,229,512 10/1980 Lenhard ..... 430/114

FOREIGN PATENT DOCUMENTS 1032804 8/1974 Canada ..... 430/115

*Primary Examiner*—John L. Goodrow
*Attorney, Agent, or Firm*—Jordan B. Bierman

[57] ABSTRACT

The present invention relates to toners for developing electrostatically charged images which are comprised of a polyester binder resin condensed from diols of the formula

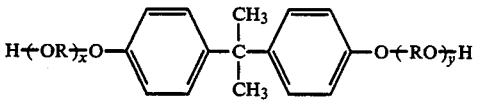

with a polyhydric carboxylic acid or a derivative thereof wherein the polyhydric carboxylic acid is a mixture of dihyridic carboxylic acid or its alkylesters and about 30 mole % to about 80 mole % of the total acid content of more hydric carboxylic acids or therein hydrids.

6 Claims, No Drawings

TONER FOR DEVELOPING AN ELECTROSTATICALLY CHARGED IMAGE

This application is a continuation of application Ser. No. 576,217, filed 2/2/84 now abandoned which is a continuation of application Ser. No. 309,840 filed 8/11/80 now abandoned which claims the priority under 35 USC 119 of Japanese Patent Application No. 112836/1980, filed on Aug. 15, 1980.

The present invention relates to a toner for developing an electrostatically charged image to be formed in an electrophotographic process, electrostatic printing process, electrostatic recording process and the like.

Electrostatically charged images are developed in that charged fine grains are attracted by an electrostatically attractive force and are adhere on the surface of an electrostatically charged image support, thereby making the electrostatic latent image visible.

There are two major types of development process for electrostatically charged images; the liquid type and dry type processes. The liquid type process uses a developing solution prepared by finely dispersing pigments or dyes into an insulated organic liquid. The dry type development process includes the cascade process, fur brush type development processes such as cascade process, fur brush processes, magnetic brush process, impression process, and powder cloud process.

An image visualized by a development process is fixed on a support as it is or is fixed after being transferred onto another support.

Thus, toners are applied not only in a development process but in the successive processes thereof, namely, an image transfer process and a fixing process. Therefore, the functions required for toners include not only an excellent developability, but also an excellent image transferability and flexability. Inter alia, the requirements for the fixability thereof is most strict and the search for improved fixability of toners and the effects thereof have been disclosed publicly in many references.

As for the heat fixing systems, there are non-contact type heat fixing systems, such as oven type fixing, and control type heat fixing systems, such as heat roller type fixing. Contact type heat fixing systems are excellent in respect of a high thermal efficiency, particularly suitable to be built in a high speed copying machine. Also this system can use a comparatively lower heat source; therefore, a fixing device can function without using high electric power. It also serves to miniaturize copying machines and to economize energy requirements. Furthermore, it reduces the danger of fire should the paper jam in the fixing device.

Contact type heat fixing systems are preferable in many respects as described above; however, in this system, an offset phenomenon is at issue. This is a phenomenon wherein a part of the toners forming an image at the time when fixing is made is transferred onto a heat roller surface, and then retransferred onto the next incoming paper thereby soiling the image thereon. In order to protect from said offset phenomenon, a variety of the proposals have so far been made and materialized in practical use. One of them is the method wherein a fixation is done with coating on a heat roller surface with an offset prevention agent such as silican oil. Another process is the method wherein a toner having an offset preventive property in itself is used. The latter simplifies the structures of a fixing device because any coating material such as silicon oil is not needed to use. And this is excellent in the aspect that any maintenance such as a supply of silicon oil is not needed.

Offset phenomenon results when the viscoelasticity of the toners fused by the heating is too low, that is, not at a suitable degree.

Therefore, an offset phenomenon can be prevented by making use of high molecular weight polymers as binder resins forming toners. The high molecular weight polymers are easily obtainable from vinyl polymers synthesized by radical polymerization, so that there are the examples using high molecular weight vinyl polymers.

However, in the case of making use of vinyl polymers, the softening point becomes higher because of the macromolecules, and an offset phenomenon can be prevented. Unfortunately, the fixing temperature also becomes higher, so that the toners of this kind cannot be practically used.

In the case that a high molecular weight polymer is used as a binder resin, defects are caused in that the resins become stiff and hard to pulverize when toners are manufactured.

In order to improve the defects as described above, vinyl polymer having a wide range of molecular weight distribution from low molecular weight to high molecular weight, which is used as a binder resin, has been disclosed in Japanese Patent Publication Open to Public Inspection No. 134652/1975. Said toner satisfies an offset phenomenon prevention function to some extent, however does not satisfy it in full. Particularly, the fixability thereof at low temperature is poor. Therefore, it is not suitable for high speed fixation, so that the difficulties will set in if said toners are used with a high speed copying machine.

On the other hand, from condensed resins such as polyester resin, a lower molecular weight resin can easily be obtained; therefore, polyester resin is very suitable to use as a resin for toners which are suitable for low temperature fixing. Further, in comparison with vinyl resins, such as styrene, polyester resin is better in "Wettability" onto a support such as transfer paper when it was fused, and in comparison with a toner containing vinyl resin having an approximately equivalent softening point to that of polyester resin, a satisfactory fixing can be made thereby at lower temperature.

For the developability or development efficiency and image transferability of a toner to be satisfactory, such toner must satisfy certain conditions. These conditions are that the toner adheres onto an electrostatically charged image support by an electrostatic traction force and that this toner have a relatively high frictional chargability due to the necessity of transfer onto another support. A popular method for applying a toner with frictional chargeability is that a charge control agent, such as dyes, is dispersed in resins forming toners. Therefore, in the manufacture of toners, the strict requirements are imposed so as to uniformly disperse said charge control agent in resins. In contrast therewith, polyester resin has suitable frictional chargeability in itself, so that it is not necessary to mix any charge control agent therein, and that the toner manufacture becomes extremely easy.

With the purpose of making the best use of the respective special characters of both vinyl resins and polyester resins as described above, Japanese Patent Publication Open to Public Inspection No. 114245/1979 has disclosed the toners wherein a mixture of high molecular weight vinyl resin and low molecular weight polyester resin serves as the binder resins thereof. However, there is still a problem in said toner that it is difficult to uniformly mix said two kinds of resins with each other.

Also, the invention in which polyester resin serves as a binder for toner use have been disclosed in Japanese Patent Publication No. 12680/1971, Japanese Patent Publication Open to Public Inspection Nos. 81540/1973 and 75043/1975, Japanese Patent Publication No. 22996/1977 and Japanese Patent Publication Open to Public Inspection No. 86342/1979. Among the above publicly known technology, Japanese Patent Publication Open to Public Inspection Nos. 75043/1975 and 86342/1979 have aimed at an offset prevention by giving polyester resin a three dimensional structure through the use of trivalent alcohol and/or trivalent carboxylic acid to be served as a part of monomer.

Also in said toners, however, the proportion of the components having the three dimensional structure is less in said resins, therefore, the offset prevention performance thereof is poor and an offset phenomenon is still caused even at a comparatively low temperature.

Especially, such offset phenomenon is caused on a roller type fixing device even by a slight nonuniformity in of temperature distribution on a heat roller surface. The changes of transfer paper sizes and the like are the factors to cause an such nonuniformity in the temperature of a heat roller surface, and in the case as described above there is danger of causing an offset phenomenon. And, when continuing to copy in great quantity, the toner components accumulate gradually on a heat roller surface, though the extent of accumulation thereof is hardly visible, and thus a defect will be caused lowering the quality of copied image.

Accordingly, an object of the present invention is to provide novel types of toners for developing an electrostatically charged image, wherein the defects of the publicly known toners as mentioned above, have been improved.

Another object of the present invention is to provide the toners for developing an electrostatically charged image which are suitable for a contact type heat fixing system, particularly for a roller fixing.

The above mentioned objects can be achieved by providing a toner for developing an electrostatically charged image, wherein the binder thereof is polyester resin which has condensedly polymerized with the component of diol shown in the following general formula:

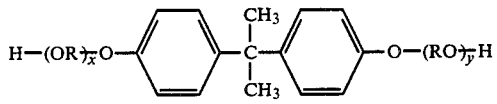

wherein R represents ethylene group or propylene group, X and Y have a value of an integral number respectively of which average value of the sum thereof is 2–7, and with the component of polyhydric carboxylic acid or the derivative thereof, which is a mixture of dihydric carboxylic acid or lower alkylester thereof and trihydric or more polyhydric carboxylic acid or the acid anhydride thereof, and the contents of said trihydric or more polyhydric carboxylic acid or the acid anhydride thereof are within the range of 30–80 mol% of the acid components.

As for the examples of diols which can be formularized by the above general formula, polyoxypropylene(2,2)-2,2-bis(4-hydroxyphenyl)propane, polyoxypropylene(3,3)-2,2-bis(4-hydroxyphenyl)propone, polyoxyethylene(2,0)-2,2-bis(4-hydorxyphenyl)propane, polyoxypropylene(2,0)-polyoxyethylene(2,0)-2,2-bis(4-hydroxyphenyl)propane and the like can be given.

And, as for dihydric carboxylic acids, dimers of maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, linolenic acid and the like, are given as the examples thereof.

Among the above, terephthalic acid and isophthalic acid are particularly preferable.

As for trihydric or more polyhydric carboxylic acids, benzene 1,2,4 tricarboxylic acid, benzene 1,2,5 tricarboxylic acid, cyclohexane 1,2,4 tricarboxylic acid, naphthalene 2,5,7 tricarboxylic acid, naphthalene 1,2,4 tricarboxylic acid, butane 1,2,4 tricarboxylic acid, hexane 1,5,5 tricarboxylic acid, 1,3-dicarboxy-2-methylcarboxypropene,1,3-dicarboxy-2-methyl-2-methylcarboxypropane tetra(methylenecarboxy)methane, 1,2,7,8 octane tetracarboxylic acid, empol trimer and the acid anhydride thereof, are preferable.

Among the above, benzene 1,2,4 tricarboxylic acid is particularly preferable.

Polyesters of the present invention are prepared through the reaction process of diol with polycarboxylic acid.

As for the catalysts to be normally used for said reaction, tin oxide, zinc oxide, titanium oxide, dibutyl tin dilaurate, dibutyl tin oxide and the like are examples thereof.

The ratio of the number of carboxyl groups in the aforementioned polycarboxylic acid composition to the number of hydroxyl groups in the aforementioned diol composition is within the range between 1.2-and 0.8, particularly between 1.1 and 0.9.

In synthesizing polyesters of the invention, a small amount (10 mol% at most) of the other polyols can be jointly used, besides the etherified bisphenols as shown in the above general formula.

As for the above polyol components, ethylene glycol, diethylene glycol, triethylene glycol, 1,2-propylene glycol, 1,3-propylene glycol, 1,4-butane diol, neopentyl glycol, 1,4-butene diol, 1,4-bis(hydroxymethyl)cyclohexane, bisphenol A, pentaerythritol, hydrogen added bisphenol A and the like can be given as the examples thereof.

Toners in which the above mentioned resins relating to the present invention (hereinafter referred to as the resins of the invention) serve as binders thereof have the characteristics that a fixation thereof can be performed at a comparatively low temperature.

Accordingly, the resins of the invention can get off with less energy for fixation thereof, and are suitable for a high speed fixation.

The resins of the invention are of such a nature that they do not demonstrate the offset phenomenon.

To maintain this nature, the acid component forming the resin of the invention must be 30–80 mole % based on the total acid content of a trihydric or more polyhydric carboxylic acid.

In the case that the ratio of aforesaid polyhydric carboxylic acid contents is at 30 mol% or lower, the offset prevention effect becomes lower and an offset phenomenon occurs at a comparatively lower fixing temperature, and thus an image quality is lowered. In the case that said ratio is over 80 mol%, the softening point becomes excessively higher, and the fixing temperature becomes so high that it is not desirable in practical use. Also, in said case the resins will become stiff and consequently the grindability thereof is decreased and thus said resins have disadvantages in the manufacture of toners.

It is more desirable that the resins of the invention have a glass transition point of 50° C. or higher. In the case that said glass transition point is at 50° C. for lower, the toner powders will have a cohesiveness and will tend to lump according to the usage of the toner, and thus there ae instances where the treatments thereof may be interfered. And, it is more desirable that the resins of the invention have a softening point (in a ring and ball method) within the range between 110°–160° C.

In the case that the softening point thereof is lower than 110° C., there are undesirable instances where the aforesaid phenomenon, that is, a cohesiveness is caused.

When the softening point thereof rises higher than 160° C., the fixedness is increased and consequently the resins of the invention will interfere with the operation of office copying machines of normal type.

Toners for developing an electrostatically charged image generally comprise binder resins, coloring agents and other characteristic improving agents.

And, in a magnetic toner, there contains a coloring agent and a magnetic substance, or a magnetic substance in place of a coloring agent.

As for the coloring agents, carbon black, nigrosine dyes (C.I. No. 50415B), aniline blue (C.I. NO. 50405), chalcoil blue (C.I. No. azoec Blue 3), chrome yellow (C.I. No. 14090), ultramarine blue (C.I. No. 77103), DuPont Oil Red (C.I. No. 26105), quinoline yellow (C.I. No. 47005), methylene blue chloride (C.I. No. 52015), phthalocyanine blue (C.I. No. 74160), malachite green oxalate (C.I. No. 42000), lump black (C.I. No. 77266), rose bengal (C.I. No. 45435), the mixtures thereof, and the like, are examples. It is required to contain said coloring agents having a sufficient weight proportion so that a satisfactory visible image can be formed by a development, and said ratio of contents is normally in the range of about 1-about 20 parts thereof by weight to 100 parts by binder resins.

As for the magnetic substances, alloys or compounds containing elements indicating ferromagnetism such as iron, cobalt and nickel including ferrite and magnetite are suitable. Alloys which do not contain any ferromagnetic element but show some ferromagnestism through a suitable heat treatment, for example, alloys of the so-called Heusler's alloys containing manganese and copper such as manganese-copper-aluminium or manganese-copper-tin, or chromium dioxide, are also suitable as the magnetic substance. Said magnetic substances are uniformly dispersed into binder resins, in form of fine grains having an average diameter of 0.1μ.

It is desirable that the contents of said magnetic grains be 20–70 parts by weight, preferably 40–70 parts by weight, to 100 parts by weight of toners.

Toners of the invention are excellent in surface lubricity. When the toners of the invention are used, offset phenomenon can be prevented even without coating the fixing roller surface with an offset prevention solution such as silicon oil. Therefore, these toners are remarkably advantageous to mechanical designing.

Next, the synthesis examples and the embodiment examples of the typical resins of the present invention are now described hereafter, however it is to be understood that the invention is not limited thereto.

SYNTHESIS EXAMPLE 1

700 grams of polyoxypropylene(2,2)-2,2-bis(4-hydroxyphenyl)propane and 97.2 grams of terephthalic acid were poured in a four-mouthed round bottom flask of one liter capacity providing a thermometer, stainless steel agitator, glass made nitrogen induction pipe and down-draft type capacitor. Next, the flask was placed in a mantle heater and nitrogen gas was induced from the glass made induction pipe, and the inside of a reactor was kept in an inactive atmosphere and the temperature therein was raised. 0.05 gram of dibutyul tin oxide was added and kept at 200° C., and reacted. Then 156 grams of benzene 1,2,4 tricarboxylic acid anhydrous were added and further reacted therein.

The reaction process thereof was traced at the softening point by a ring and ball method. When the softening point reacted at 120° C., the reaction was stopped and cooled down to room temperature. The resins thusly obtained were light yellow solids which were powdered easily, and the glass transition point thereof was at 58° C. when measured with a differential calorimeter.

SYNTHESIS EXAMPLE 2

490 grams of polyoxyproylene (2,2)-2,2-bis(4-hydroxyphenyl)propane, 195 grams of polyoxyethylene(2)-2,2-bis(4-hydroxyphenyl)propone, 97.2 grams of isophthalic acid and 1,2,4-benzentricarboxylic acid were reacted together at 200° C. by means of the same equipments as used in the Synthesis Example 1. The reaction was stopped when the softening point in a ring and ball method reached 127° C., and the reaction mixture was then cooled down to room temperature. The resins thusly obtained were light yellow solids which were powdered easily, and the glass transition point thereof was at 61° C. when measured with a differential calorimeter.

EMBODIMENT EXAMPLE 1

A mixture of 95 parts of the resins obtained in Synthesis Example 1 and 5 parts of carbon blacks was prepared by means of a ball mill, and mixedly kneaded by means of a heat roller, and cooled. This was then finely pulverized by a jet grinder and thus the toners having an average grain diameter of 13–15 microns were obtained.

Developers were prepared by adding 95 parts by weight of iron powder carriers to 5 parts by weight of said toners. An electrostatically charged image formed by means of an electrophotographic copying machine, U-Bix V, (mfd, by Konishiroku Photo Ind. Co., Ltd,), was developed with this developer through a normal electrophotographic copying process.

The toner image thus obtained through the development process was transferred to a plain paper onto which a fixing roller of which surface was made of Teflon (mfd. by DoPont-polytetrafuoroethylene) and a pressing roller of which surface was made of silicon rubber KE-1300 RTV (mfd. by Shinetsu Chemical Ind. Co.) were pressed to contact and the toner image was fusedly adhered and fixed thereon. Next, in order to determine whether an offset phenomenon occurs or not, a fixation was processed and a blank paper was pressed to contact with a fixing roller on the same conditions as described above. The blank paper was then examined for staining by the toners.

As the result of the observation, the temperature for the growth of an offset phenomenon was at 200° C. After a 5,000 continuous copying run was completed, sharp copy images without any fog were still obtainable.

EMBODIMENT EXAMPLE 2

Next, some sorts of the embodiment examples and the comparison examples, wherein the polyester resins synthesized by the process according to the Synthesis Example 1, are shown in the following Table 1.

As is apparent from the Table, the toners of the invention have the extremely excellent characteristics in that no offset phenomenon occurs until unexpectedly high temperatures are reached.

Also, when a 5,000 continuous copying was performed, the sharp copy images without any fog were still obtainable as shown in Table 1.

Further, as shown in Table 1, with the toners wherein the ratio of tri- or more hydric polycarboxylic acid to the amount of the acid components was at 25% the temperature for the growth of an offset phenomenon was low, and therefore the said toners were not applicable to practical use. With the toners wherein the ratio of tri or more hydric polycarboxylic acid to the amount of acid component was at 85% the softening point thereof was high and poor fixation was caused, and therefore the said toners were not applicable also to practical use. Therefore, it is readily seen that the toners where the tri or more hydric polycarboxylic acid to the amount of total acids is beyond the range of this invention, results are poor, whereas they are excellent when the tri or more hydric polycarboxylic acid is kept within the range of the invention.

TABLE 1

| | Component ratio & Characteristic value | | | | | | |
|---|---|---|---|---|---|---|---|
| Sample Nos. | Dicarboxylic acid 1 (mol %) | Dicarboxylic acid 2 (mol %) | Benzene 1,2,4 tricarboxylic acid (mol %) | Diol 1 (mol %) | Diol 2 (mol %) | Diol 3 (mol %) | Diol 4 (mol %) |
| Embodiment Example 1 | 0.30 | — | 0.40 | 1.0 | — | — | — |
| Embodiment Example 2 | — | 0.30 | 0.40 | 0.7 | — | 0.3 | — |
| Embodiment Example 3 | 0.50 | — | 0.33 | — | 1.0 | — | — |
| Embodiment Example 4 | 0.55 | — | 0.36 | 0.5 | 0.5 | — | — |
| Embodiment Example 5 | 0.33 | — | 0.45 | 0.5 | — | 0.5 | — |
| Embodiment Example 6 | 0.29 | — | 0.41 | 0.7 | — | 0.3 | — |
| Embodiment Example 7 | — | 0.29 | 0.41 | 0.665 | — | 0.285 | 0.05 |
| Comparison Example 1 | 0.712 | — | 0.237 | 1.0 | — | — | — |
| Comparison Example 2 | 0.147 | — | 0.833 | 1.0 | — | — | — |

| | Component ratio & characteristic value | | | | | |
|---|---|---|---|---|---|---|
| Sample Nos. | Mol number of tri- or more hydric carboxylic acid/ mol number of acid (mol %) | Number of carboxyl group/ Number of hydroxyl group | Softening point (Ring & Ball method) (°C.) | Glass transition point (°C.) | Offset growth temperature (°C.) | Image quality valuation |
| Embodiment Example 1 | 57.1 | 0.900 | 122 | 58 | 215 | Sharp copy images without fog |
| Embodiment Example 2 | 57.1 | 0.900 | 127 | 61 | 240 | Sharp copy images without fog |
| Embodiment Example 3 | 39.7 | 1.000 | 122 | 53 | 240 | Sharp copy images without fog |
| Embodiment Example 4 | 39.5 | 1.090 | 130 | 63 | 240 | Sharp copy images without fog |
| Embodiment Example 5 | 57.6 | 1.005 | 120 | 68 | 200 | Sharp copy images without fog |
| Embodiment Example 6 | 58.5 | 0.905 | 125 | 63 | 240 | Sharp copy images without fog |
| Embodiment Example 7 | 58.5 | 0.905 | 122 | 58 | 240 | Sharp copy images without fog |
| Comparison Example 1 | 25.0 | 1.067 | 128 | 73 | 150 | A little poor copy image |
| Comparison Example 2 | 85.0 | 1.397 | 180 | 76 | Poor fixation | A little poor copy |

TABLE 1-continued image

Note:
Dicarboxylic acid 1: Terephthalic acid
Dicarboxylic acid 2: Isophthalic acid
Diol 1: Polyoxypropylene (2,2)-2,2-bis(4-hydroxyphenyl)propane
Diol 2: Polyoxypropylene (3,3)-2,2-bis(4-hydroxyphenyl)propane
Diol 3: Polyoxyethylene (2,0)-2,2-bis(4-hydroxyphenyl)propane
Diol 4: Polyethylene glycol (Molecular weight: 400)

We claim:

1. A toner for developing an electrostatically charged image which comprises a binder polyester resin which was condensedly polymerized from a diol represented by the following general formula

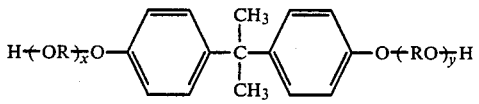

wherein R represents ethylene group or propylene group, x and y are respectively integers of which average value of the sum thereof is 2 to 7; and a polyhydric carboxy acid or a derivative thereof, which is a mixture of dihydric carboxylic acid or lower alkylester thereof and trihydric or more polyhydric carboxylic acid or an acid anhydride thereof, wherein the content of said trihydric or more polyhydric carboxylic acid or the acid anhydride thereof is within the range of 30 to 80 mole percent of said polyhydric carboxy acid or derivative thereof.

2. Toner according to claim 1, wherein said trihydric carboxylic acid is benzene 1,2,4-tricarboxylicacid.

3. Toner according to claim 1, wherein said dihydric carboxylic acid is terephthalic acid or a lower alkylester thereof.

4. Toner according to claim 1, wherein glass transition point of said resin is 50° C. or more and softening point thereof is 110° C. to 160° C.

5. A toner for developing an electrostatically charged image which comprises a binder polyester resin which was condensely polymerized from a diole represented by the following general formula

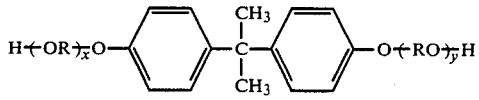

wherein R represents an ethylene group or a propylene group, x and y are respectively integers of which the average value of the sum thereof is 2 to 7; and a polyhydric carboxy acid or a derivative thereof, which is a mixture of a dihydric carboxylic acid or lower alkylester thereof and trihydric or more polyhydric carboxylic acid or an acid anhydride thereof, wherein the content of said trihydric or more polyhydric carboxylic acid or the acid anhydride thereof is within the range of 30 to 80 mole% of said polyhydric carboxy acid or derivative thereof and said toner further comprising at least one member selected from the group consisting of a colorant and a magnetic substance.

6. A binder polyester resin comprising the condensation polymerization product of a diole represented by the following general formula

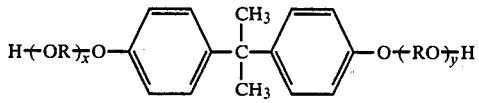

wherein R represents and ethylene group or a propylene group, x an y are respectively integers of which the average value of the sum thereof is 2 to 7; and a polyhydric carboxy acid or a derivative thereof, which is a mixture of a dihydric carboxylic acid or lower alkylester thereof and trihydric or more polyhydric carboxylic acid or an acid anhydride thereof, wherein the content of aid trihydric or more polyhydric carboxylic acid or the acid anhydride thereof is within the range of 30 to 80 mole% of said polyhydric carboxy acid or derivative thereof.

* * * * *

UNITED STATES PATENT AND TRADEMARK OFFICE

CERTIFICATE OF CORRECTION

PATENT NO. : 4,657,837

DATED : April 14, 1987

INVENTOR(S) : MORITA, et al

It is certified that error appears in the above-identified patent and that said Letters Patent is hereby corrected as shown below:

On the title page:Item

Change
"[73] Assignee: Konishiroku Photo Industry Co., Ltd.,
Tokyo, Japan"

to
--[73] Assignee: Konishiroku Photo Industry Co., Ltd.,
and Kao Soap Co., Ltd.,
Tokyo, Japan --

Signed and Sealed this

Tenth Day of January, 1995

Bruce Lehman

*Attest:*

BRUCE LEHMAN

*Attesting Officer*

*Commissioner of Patents and Trademarks*